US010138036B1

(12) United States Patent
Schwimer

(10) Patent No.: US 10,138,036 B1
(45) Date of Patent: Nov. 27, 2018

(54) BEVERAGE CONTAINER SOUND DEVICE

(71) Applicant: Kevin Schwimer, Beverly Hills, CA (US)

(72) Inventor: Kevin Schwimer, Beverly Hills, CA (US)

( * ) Notice: Subject to any disclaimer, the term of this patent is extended or adjusted under 35 U.S.C. 154(b) by 182 days.

(21) Appl. No.: 14/928,130

(22) Filed: Oct. 30, 2015

Related U.S. Application Data

(60) Provisional application No. 62/073,239, filed on Oct. 31, 2014.

(51) Int. Cl.
*B65D 51/24* (2006.01)
*B65D 17/28* (2006.01)
*B65D 55/02* (2006.01)

(52) U.S. Cl.
CPC ..... *B65D 51/248* (2013.01); *B65D 17/4012* (2018.01); *B65D 55/028* (2013.01); *B65D 2203/12* (2013.01); *B65D 2517/0013* (2013.01); *B65D 2517/0089* (2013.01)

(58) Field of Classification Search
CPC .. B65D 51/248; B65D 51/007; B65D 17/165; B65D 85/72; B65D 2517/0013; B65D 2517/0089; Y10S 220/906
USPC ..... 206/459.1, 457; 446/81, 175, 297, 397, 446/415, 420; 220/265–275, 906
See application file for complete search history.

(56) References Cited

U.S. PATENT DOCUMENTS 4,121,835 A * 10/1978 Garabedian ..... A47G 21/182 138/121
5,099,232 A * 3/1992 Howes ..... B65D 25/00 206/217
5,464,092 A * 11/1995 Seeley ..... B65D 5/4291 206/217
6,267,639 B1 * 7/2001 Menow ..... A63H 5/00 221/152
6,299,006 B1 * 10/2001 Samonek ..... B65D 23/00 116/112
2010/0200535 A1 * 8/2010 D'Angelico ..... B65D 41/12 215/316
2010/0314390 A1 * 12/2010 D'Angelico ..... B65D 51/185 220/254.1
2011/0188229 A1 * 8/2011 Rizo Hernandez .. B65D 51/248 362/86

FOREIGN PATENT DOCUMENTS

WO WO 03010064 A1 * 2/2003 ..... B65D 51/1672

* cited by examiner

*Primary Examiner* — Andrew Perreault
(74) *Attorney, Agent, or Firm* — DeLio, Peterson & Curcio, LLC; Thomas E. Ciesco

(57) ABSTRACT

A noise producing beverage container comprising a container having a surface which includes a sealed opening in the surface. The noise producing beverage container includes a sound making device attached to the interior of the container adjacent the sealed opening and an arm movable upon opening the sealed opening to contact the sound making device. The sealed opening is initially in a closed position and upon opening the sealed opening the arm contacts the sound making device to produce a sound.

5 Claims, 4 Drawing Sheets

BEVERAGE CONTAINER SOUND DEVICE

BACKGROUND OF THE INVENTION

1. Field of the Invention

The present invention relates to a beverage container which includes a sound device which produces a distinct sound when the beverage container is opened.

2. Description of Related Art

Companies in the beverage industry invest millions of dollars a year in new marketing concepts and advertising. These campaigns range from creating new packaging for existing products, to producing and promoting completely new beverage products for consumers. Some of the ways beverage companies distinguish their products from the thousands of others brands in the space are by creating new flavors, promoting nutritional value, and developing unique packaging. There is a need for beverage companies to distinguish their brands and products in other ways that has yet to be fully explored as a marketing tool.

SUMMARY OF THE INVENTION

Bearing in mind the problems and deficiencies of the prior art, it is therefore an object of the present invention to provide a beverage container which makes a distinct sound when the beverage container is opened.

It is another object of the present invention to provide a sound device within a beverage container having a pop-top opening, the device producing a distinct sound when the pop-top seal strikes the sound device.

A further object of the invention is to provide a sound device attachable to the interior of an aluminum beverage container having a pop-top opening, the sound device producing a distinct sound when the pop-top seal is opened.

It is yet another object of the present invention to provide a method of producing a distinct sound when a beverage container is opened.

Still other objects and advantages of the invention will in part be obvious and will in part be apparent from the specification.

The above and other objects, which will be apparent to those skilled in the art, are achieved in the present invention which is directed to noise producing beverage container comprising a container having a surface which includes a sealed opening in the surface. The noise producing beverage container includes a sound making device attached to the interior of the container adjacent the sealed opening and an arm movable upon opening the sealed opening to contact the sound making device. The sealed opening is initially in a closed position and upon opening the sealed opening the arm contacts the sound making device to produce a sound. The arm may be a pre-scored seal tongue rotatable from an initial sealed position to a fully open position whereby a beverage within the beverage container is accessible though the opening. The sealed opening may include a rotatable tongue and the arm extends from the tongue, the arm contacting the sound making device to produce a sound when the tongue is rotated from an initially sealed position to a fully open position. The sound making device may include a base attachable to the interior of the container and a reed extending from the base, the reed producing a noise when struck by the movable arm. The noise producing beverage container may include at least one additional reed extending from the base whereby a plurality of sounds are produced when the arm strikes the reeds. The sound making device may include a bell and the movable arm strikes the bell upon opening the sealed opening, producing a ringing sound when the beverage container is opened. The arm may include a plurality of fingers and the sound making device may include a plurality of reeds, each finger striking a different reed when the beverage container is opened, whereby a plurality of sounds is produced. The sound producing device may include a ratchet gear and ratchet bar, the arm pushing the ratchet bar about the ratchet gear when the beverage container is opened and producing a ratchet sound.

The rotation of the tongue initiated by the opening of the beverage container supplies the force needed to strike or pluck the reed so no other energy supply is required. The energy of the user opening the beverage container is sufficient for generating the sound from the sound generating device.

In another aspect the present invention is directed to a noise producing beverage container comprising an outer container having a top surface which includes a pre-scored seal and a seal tab for making an opening in the top surface. The noise producing beverage container includes a sound making device attached to the interior of the container adjacent the pre-scored seal wherein the seal is initially in a closed position and the rotating of the seal tab forces the seal downward, activating the sound making device whereby a sound is produced from the sound making device. The sound producing device may be attached to the interior of the container adjacent the pre-scored seal, the sound producing device may include a base structure and at least one cavaliered bar extending from the base structure. The sound making device may include a base attachable to the interior of the container and a reed extending from the base, the reed producing a noise when struck by the seal tab. The noise producing beverage container may include at least one additional reed extending from the base whereby a plurality of sounds is produced when the seal tab strikes the reeds. The sound making device may include a bell and the seal tab may strike the bell upon opening the sealed opening, producing a ringing sound when the beverage container is opened. The arm may include a plurality of fingers and the sound making device includes a plurality of reeds, each finger striking a different reed when the beverage container is opened, whereby a plurality of sounds is produced. Each of the plurality of reeds may be struck by the seal tab at a different time than the other reeds, producing a melody. The sound producing device may include a ratchet gear and ratchet bar and the seal tab may push the ratchet bar about the ratchet gear when the beverage container is opened, producing a ratchet sound.

In another aspect, the present invention is directed to a method of using a noise producing beverage container comprising providing a container having a surface which includes a sealed opening in the surface, a sound making device attached to the interior of the container adjacent the sealed opening and an arm movable upon opening the sealed opening to contact the sound making device. The method includes breaking the seal of the sealed opening and moving the arm to contact the sound making device. The arm may be a pre-scored seal tongue rotatable from an initial sealed position to a fully open position and the step of moving the arm to contact the sound making device may include rotating the tongue from the initial sealed position to the fully open position. The sealed opening may include a rotatable tongue and the arm may extend from the tongue and the step of moving the arm to contact the sound making device may include rotating the tongue downward so the arm contacts the sound making device to produce a sound when the tongue is rotated downward. The sound making device may include a base attachable to the interior of the container and a reed extending from the base, and the step of moving the arm to contact the sound making device may include moving the arm to strike the reed to produce a sound.

The beverage container sound device relies on the use of sound recognition as a distinctive identifier for a beverage served in a container, and in particular to a device that is added to the inside of a beverage container during the manufacturing process that will create a unique and distinct noise or sound when the container is opened for consumption. The present invention may be comprised of a beverage or other container having an opening for a user's mouth to consume the beverage, and a removable cap over the opening. A sound-producing device is disposed adjacent the container opening and, upon opening the beverage container, emits a distinctive sound or noise. The sound-producing device may be disposed inside the container or outside the container. The sound or noise is generated by the physical movement of the cap upon opening. In use, the present invention provides to the consumer or user a sound-producing device such as one described herein, and the consumer or user generates the sound or noise upon opening the container.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-14 of the drawings in which like numerals refer to like features of the invention.

Figure 1:
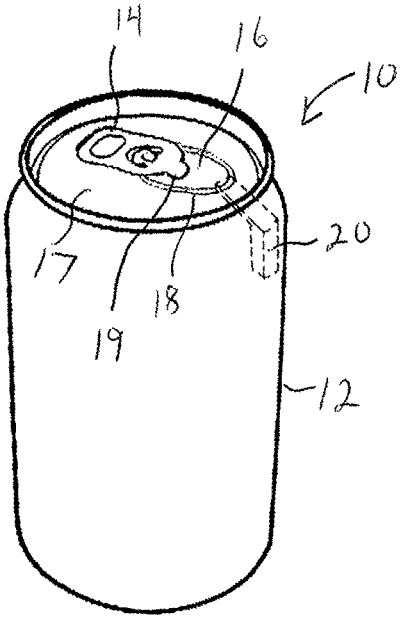
FIG. 1 is a perspective view of the noise producing beverage container according to the present invention.

FIG. 1 shows a sound producing beverage container 10 having a cylindrical base 12 and a circular top cover 17. The container may hold any type of soft drink or alcoholic beverage, such as beer, or other liquid. The top cover 17 includes a pop-top access opening for a user's mouth to consume the beverage which includes a pull tab 14 and an integrated seal or tongue 16 which seals an opening 18 in the top cover. The tongue 16 is integrated with the top cover 17 which includes a pre-scored stress seal along a portion of the periphery of the tongue 16 so that when the tongue 16 is urged in a downward direction, the tongue 16 releases from the cover 17 along the pre-scored stress seal. A hinge portion of the periphery of the tongue 16 does not have the pre-scored stress seal so that the tongue 16 rotates about the second portion of the periphery when pressed downward by the pull tab 14. While the container 10 is depicted as a metal, e.g., aluminum, can, it may be in any configuration, e.g., a bottle, and made out of any suitable material such as glass or plastic. Opening 18 and the seal for the opening may be of any suitable configuration, such as a resealable or friction-fitted non-resealable twist-off cap for an otherwise conventional bottle opening.

Figure 2:
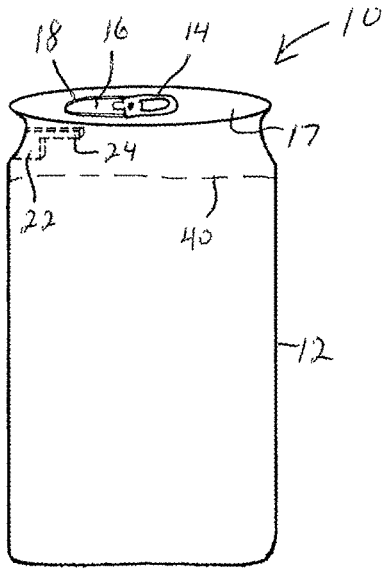
FIG. 2 is a side/top perspective view of the noise producing beverage container shown in FIG. 1 with the pop-top in an initial closed position.
Figure 3:
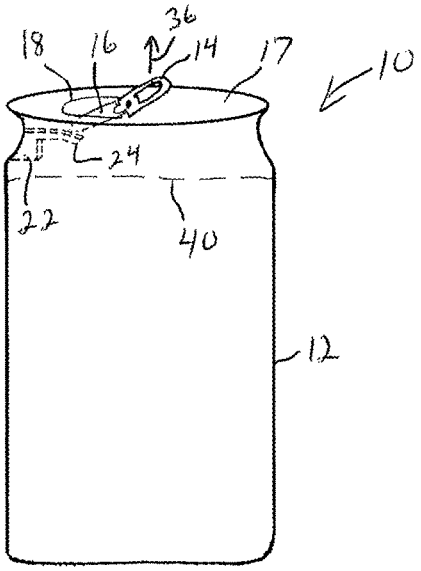
FIG. 3 is a side/top perspective view of the noise producing beverage container shown in FIG. 1 with the pop-top in a first opened position.
Figure 4:
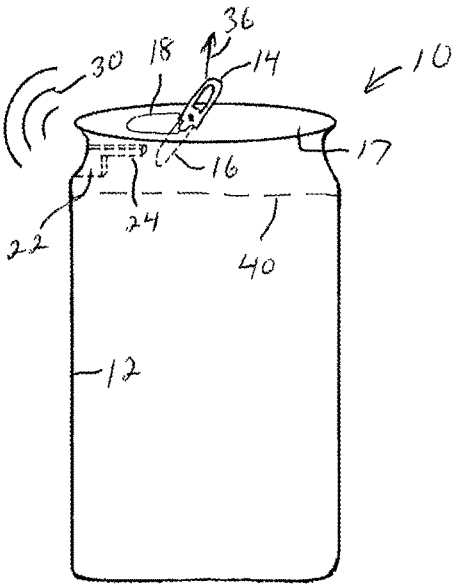
FIG. 4 is a side/top perspective view of the noise producing beverage container shown in FIG. 1 with the pop-top in a second opened position.

The sound producing beverage container includes a sound or noise producing device 20 which includes a base 22 attached to the inner side wall of the container and a reed 24 as shown in FIGS. 2-4. The noise producing device 20 may be disposed above the normal top level 40 of the beverage when the container is in the normal upright position. The reed 24 or cantilevered bar makes a percussion sound when struck or plucked. The percussion sound may be a short burst of sound or may be a longer resonating sound. When the pull tab 14 is pulled upwardly, a stub 19 on the pull tab 14 presses on the tongue 16, rotating the tongue 16 in a downward direction. During rotation the tongue 16 acts as an arm and contacts the reed 24, plucking the reed 24 as the tongue 16 continues to rotate. The plucking of the reed creates a sound 30 (FIG. 4).

In a method for using the sound producing beverage container as shown in FIGS. 2-4, a user secures in one hand the beverage container shown in FIG. 2 and using a combination of fingers and thumb, grasps the pull tab 14 and pulls upward in the direction shown by arrow 36 in FIG. 3, rotating the tongue 16 against the reed 24, bending the free end of the reed 24 downwardly. As the user continues to pull in the direction of arrow 36 as shown in FIG. 4, the further rotation of the tongue 16 allows the reed to snap back, producing a percussion sound.

Figure 5:
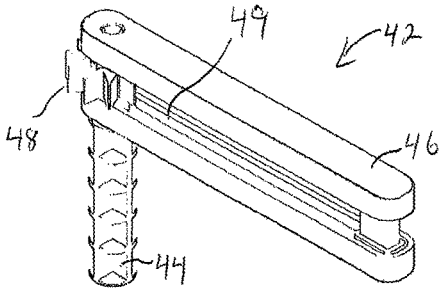
FIG. 5 is a perspective view of an alternate sound device according to the present invention.

FIGS. 5-10 show various embodiments of the sound producing device. In FIG. 5, a ratcheting device 42 includes a base handle 44 attached to a ratchet gear 48. A ratchet bar 46 having a reed 49 rotates about the base handle 44, making a sound as the reed 49 snaps against the teeth on the ratchet gear 48. The noise producing beverage container shown in FIG. 13 includes the ratcheting sound producing device 42 held on the inner side wall of the container by base 45, which makes a noise in a similar fashion when it is contacted by tongue or arm 16 and rotates with respect to the base.

Figure 6:
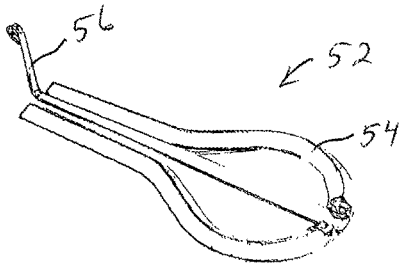
FIG. 6 is a perspective view of a second alternate sound device according to the present invention.
Figure 7:
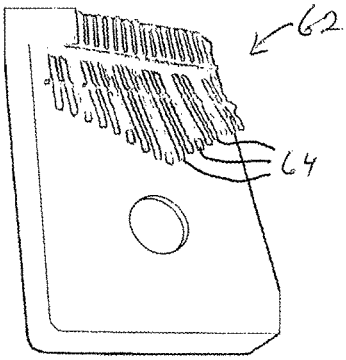
FIG. 7 is a perspective view of a third alternate sound device according to the present invention.
Figure 11:
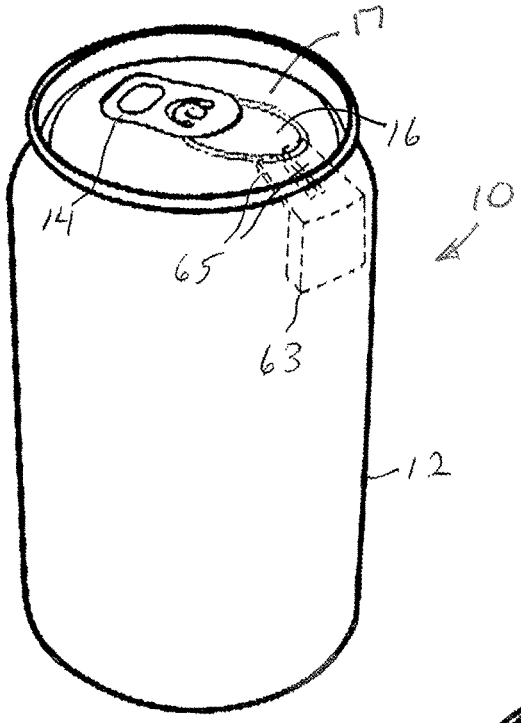
FIG. 11 is a perspective view of a noise producing beverage container using the sound device of FIG. 7.

FIG. 6 shows a sound producing device 52 having a single reed 56 connected to a base 54. FIG. 7 shows a sound producing device 62 which includes a plurality of reeds or fingers 64 and may be used as the sound producing device in a beverage container as shown in the embodiment of FIG. 11, where a plurality of reeds or fingers 64 are shown on a base 63 attached to the cylindrical base 12. The reeds or fingers 64 produce a sound when contacted by arm or tongue 16 during opening of the container.

Figure 8:
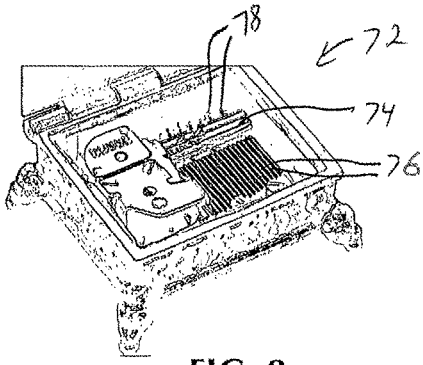
FIG. 8 is a perspective view of a fourth alternate sound device according to the present invention.

FIG. 8 shows a sound producing device which may include a plurality of fingers 78 on the tab 74 and a plurality of reeds 76, each finger 78 striking a different reed when the beverage container is opened, whereby a plurality of sounds is produced as in a musical box.

Figure 9:
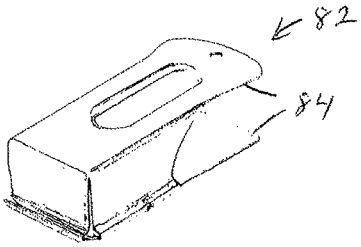
FIG. 9 is a perspective view of a fifth alternate sound device according to the present invention.

FIG. 9 shows a cricket device 82 which includes a pair of levers 84 which when forced together produces a snapping sound. The cricket 82 may be attached to the interior of the cylindrical base so the tongue 16 presses against at least one of the cricket levers 84.

Figure 10:
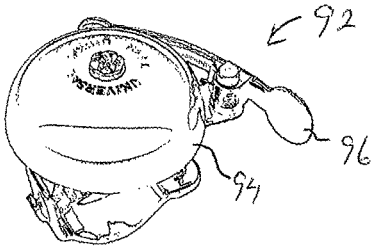
FIG. 10 is a perspective view of a sixth alternate sound device according to the present invention.
Figure 12:
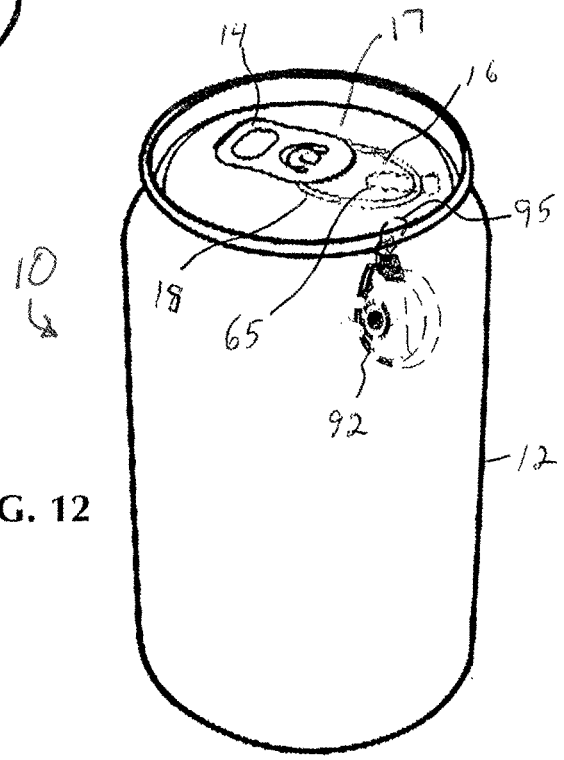
FIG. 12 is a perspective view of a noise producing beverage container using the sound device of FIG. 10.
Figure 13:
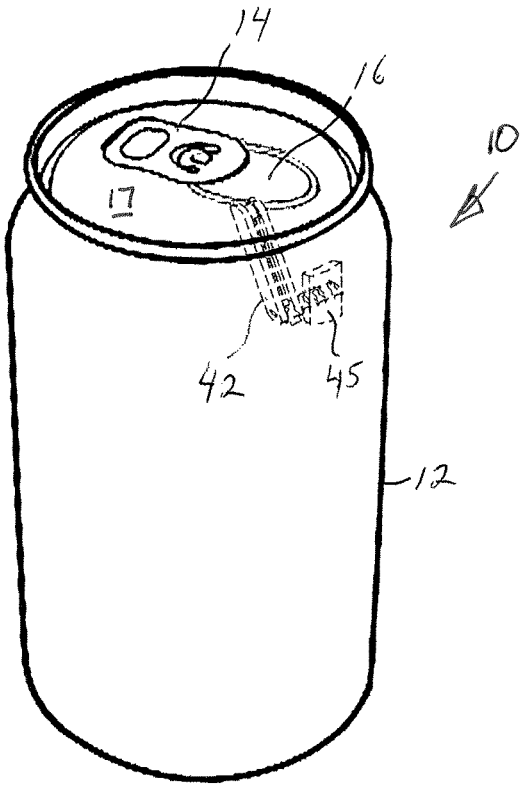
FIG. 13 is a perspective view of a noise producing beverage container using the sound device of FIG. 5.

FIG. 10 shows a sound producing device 92 which includes a bell 94 and a striking lever 96. As shown in FIG. 12, the tongue 16 may strike the lever 96 which strikes the bell 94, or alternately, the tongue 16 may strike the bell directly. FIG. 12 also shows a tongue arm 65 which extends from the tongue 16 so that the sound producing device may be attached further from the beverage container opening 18 so the device will not affect the use of the opening to dispense the beverage. The tongue arm 65 may be used in any of the embodiments above.

Figure 14:
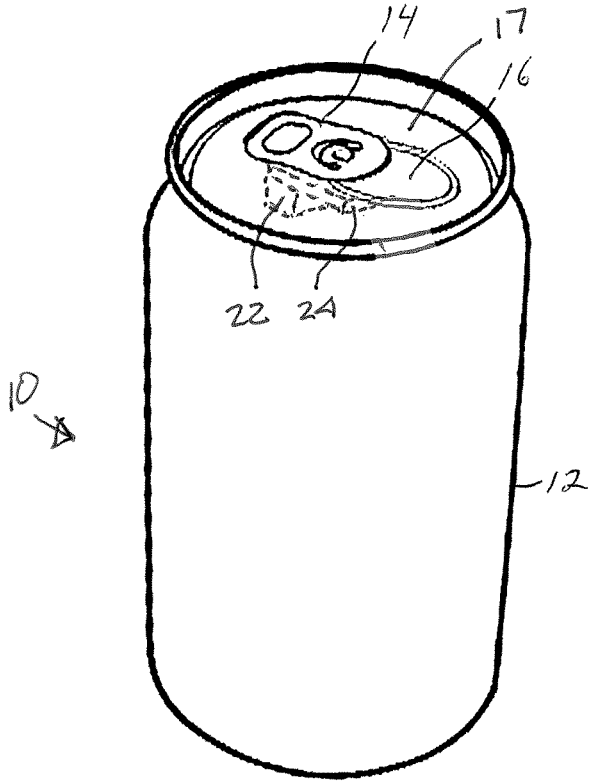
FIG. 14 is a perspective view of a noise producing beverage container with the sound device secured to the underside of the container cover.

In addition to location on the inner side wall of the container as shown above, the sound producing device may be disposed in any location within the interior of the container. In FIG. 14, a further example is depicted where the sound producing device, reed 24, is secured to the underside of the container top cover 17. During rotation the tongue 16 arm plucks the reed 24 to create the sound.

Each of the embodiments of the noise producing beverage container are activated and powered by the physical movement as the container is opened. The sound-producing devices of the present invention operate mechanically to produce the desired sound, e.g., by vibration of all or a portion of the device, such as a reed, lever or bell. Other mechanical sound-producing devices may be employed, where the sound is created by physically striking the device with an arm operatively connected to and moved as a result of the opening of the sealed container.

The unique and/or distinct sound created may serve as additional marketing value for the brand of the beverage. The sound created when the beverage container is opened will further distinguish the beverage brand and increase its consumer recognition in the same way that beverages are currently marketed through unique packaging, labeling, and taste. Not only will this sound attract the attention of new consumers when the beverage is first opened and being consumed, it will also reinforce consumer awareness of the beverage brand for those that have already learned about the new device.

For example, a patron in a bar may hear a loud whistle and look over to see where the whistle is coming from. When the patron learns that the sound was created by the opening of a "Brand X" beer bottle, he or she will now associate that sound with that beverage brand. Going forward, whenever such persons are in a bar, restaurant or friend's BBQ and hear that sound, they will be reminded of the beverage "Brand X" beer, and know that the product is being consumed and enjoyed nearby.

The present invention therefore provides a beverage container which makes a distinct sound when the beverage container is opened, and may be used within the interior of a beverage container having a pop-top or other opening, producing a distinct sound when the pop-top seal or arm associated with a seal or cap strikes the sound device. The invention may be used to audibly distinguish beverage products from others products, such as by indicating brands or flavors, promoting nutritional value, or otherwise unique packaging.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A noise producing beverage container comprising:

a container having a surface which includes an opening initially sealed with a tongue in the surface opening;

a pull tab disposed on the surface adjacent the tongue; and a sound making device having a reed, the sound making device attached to the interior of the container adjacent the sealed opening, the tongue movable upon rotating the pull tab to contact the sound making device;

wherein the sealed opening is initially in a closed position and upon opening the sealed opening the tongue contacts a free end of the reed, bends the reed and releases the reed, the reed producing a percussion sound upon release.

2. The noise producing beverage container of claim 1 wherein the tongue is a pre-scored seal tongue rotatable from an initial sealed position to a fully open position whereby a beverage within the beverage container is accessible though the opening.

3. The noise producing beverage container of claim 1 including at least one additional reed extending from the base whereby a plurality of sounds are produced when the arm strikes the reeds.

4. A method of using a noise producing beverage container comprising:

providing a container containing a beverage, the container having a surface which includes an opening initially sealed with a tongue in the surface opening, the container including a pull tab disposed on the surface adjacent the tongue and a sound making device having a reed, the sound making device attached to the interior of the container adjacent the sealed opening, the tongue movable upon rotating the pull tab to contact the sound making device wherein the beverage is accessible through the opening when the seal is broken; and pulling upwardly on the tab, breaking the seal of the sealed opening and rotating the tongue against the reed, the tongue bending a free end of the reed downwardly, allowing access of the beverage through the opening;

continuing to pull on the tab until the reed end is released, producing a percussion sound.

5. The method of claim 4 including the step of accessing the beverage through the opening after the step of moving the arm to contact the sound making device.

* * * * *